US005690403A

United States Patent [19]

Ellison et al.

[11] Patent Number: 5,690,403

[45] Date of Patent: Nov. 25, 1997

[54] INSERT FOR FILLING UTILITY ACCESS OPENING IN FURNITURE PANEL

[75] Inventors: Samuel J. Ellison, Grand Rapids; Daniel N. Siegrist, Grand Blanc, both of Mich.

[73] Assignee: Steelcase Inc., Grand Rapids, Mich.

[21] Appl. No.: 553,813

[22] Filed: Oct. 23, 1995

[51] Int. Cl.[6] ..... A47B 77/08

[52] U.S. Cl. ..... 312/223.6; 108/50

[58] Field of Search ..... 312/223.6, 223.3, 312/223.1; 108/50; 16/2

[56] References Cited

U.S. PATENT DOCUMENTS

| | | | |
|---|---|---|---|
| 3,783,175 | 1/1974 | Timmons . | |
| 3,797,870 | 3/1974 | Beckman | 292/228 X |
| 4,053,701 | 10/1977 | Ogilvie et al. . | |
| 4,323,291 | 4/1982 | Ball . | |
| 4,688,491 | 8/1987 | Herrera et al. . | |
| 4,699,212 | 10/1987 | Andersson et al. | 16/2 X |
| 4,718,741 | 1/1988 | Nichoalds . | |
| 4,762,072 | 8/1988 | Boundy et al. | 108/50 |
| 4,884,513 | 12/1989 | Newhouse et al. . | |
| 4,950,839 | 8/1990 | Quinn et al. . | |
| 4,978,265 | 12/1990 | De Wan | 411/510 X |
| 5,083,512 | 1/1992 | Newhouse et al. . | |
| 5,130,494 | 7/1992 | Simonton et al. . | |
| 5,144,777 | 9/1992 | Fishel et al. . | |
| 5,154,126 | 10/1992 | Newhouse et al. . | |
| 5,162,612 | 11/1992 | Naka et al. . | |
| 5,167,047 | 12/1992 | Plumley . | |
| 5,189,779 | 3/1993 | Fishel et al. . | |
| 5,237,935 | 8/1993 | Newhouse et al. . | |
| 5,272,988 | 12/1993 | Kelley et al. . | |
| 5,291,838 | 3/1994 | Ferchau et al. . | |
| 5,429,431 | 7/1995 | Olson et al. . | |
| 5,448,809 | 9/1995 | Kraus | 24/453 |
| 5,451,101 | 9/1995 | Ellison et al. . | |

FOREIGN PATENT DOCUMENTS

| | | |
|---|---|---|
| 2245162 | 1/1992 | United Kingdom . |

*Primary Examiner*—Peter M. Cuomo
*Assistant Examiner*—Janet M. Wilkens
*Attorney, Agent, or Firm*—Price, Heneveld, Cooper, DeWitt & Litton

[57] ABSTRACT

An insert is provided for selectively filling a utility access opening in furniture where the access opening is formed in a panel in the furniture, but where the panel has a thickness that may be one of two different dimensions. The insert includes a sleeve having a stop for engaging a first surface on the panel, short retainers configured to frictionally engage an opposing surface in opposition to the stop when the panel defines a first relatively thin dimension, and long retainers configured to frictionally engage the opposing surface in opposition to the stop when the panel defines a second relatively thick dimension. A port mateably frictionally engages the insert to close the sleeve. The port is frictionally held in the sleeve by detents, and engages the retainers to hold them securely in engagement with the panel. The short retainers can be broken off so that they do not interfere with positioning the port into the sleeve when the sleeve is engaged with a relatively thick panel. A method includes breaking off the short retainers and engaging the insert with the relatively thick panel, and thereafter inserting the port into the sleeve.

16 Claims, 3 Drawing Sheets

INSERT FOR FILLING UTILITY ACCESS OPENING IN FURNITURE PANEL

BACKGROUND OF THE INVENTION

The present invention includes an insert for filling utility access openings in furniture panels on furniture articles, such as a desk adapted for use with electrical devices.

Modern furniture is often adapted to support electrical devices such as computers, telephones, and the like, such as by including structure for holding electrical outlets or communication connectors under the worksurface of the furniture, and by providing an access opening through a worksurface or a side panel to access the outlets or communication connectors. Preferably, the access openings are covered to make them visually attractive. For example, access openings in the furniture for receiving wires and the like are often covered with an insert or trim piece to partially hide or cover the openings. However, this can result in a plurality of different inserts and trim pieces which are expensive to inventory and can cause frustration during on-site assembly due to lack of appropriate inserts and/or trim pieces. The problem is complicated by panels that are substantially the same shape but that have different thicknesses. It is also undesirable to provide inserts and trim pieces that require additional or specialized tools for installation, or that require experienced and/or skilled labor for installation.

Thus, an insert for filling utility access opening is desired solving the aforementioned problems, and in particular which is adapted to fill different access openings without the need for separate or addition pieces or tools, but that is adapted to securely, interlockingly engage the access opening to prevent accidental disengagement of the insert.

SUMMARY OF THE INVENTION

In one aspect, the present invention includes an insert that can be used to selectively fill a utility access opening in furniture where the access opening is formed in a panel in the furniture, the panel having a first surface and an opposing surface defining a predetermined thickness that is one of at least two different thickness dimensions. The insert includes a sleeve having a stop for engaging the first surface on the panel and further having first retainers configured to frictionally interlockingly engage the opposing surface in opposition to the stop when the panel defines a first thickness dimension and still further having second retainers configured to frictionally interlockingly engage the opposing surface in opposition to the stop when the panel defines a second thickness dimension. In a preferred form, the insert further includes a port for mateably engaging the sleeve and covering the access opening, which port frictionally engages the retainers to securely hold the retainers in interlocking engagement with the panel. In one aspect, the shorter of the two type retainers can be broken off so that the shorter of the retainers do not interfere with insertion of the port into the sleeve when engaging a relatively thicker panel.

The present invention further includes a method of installing the insert.

These and other features and advantages of the present invention will be further understood and appreciated by those skilled in the art by reference to the following specification, claims, and appended drawings.

DETAILED DESCRIPTION OF PREFERRED EMBODIMENTS

Figure 1:
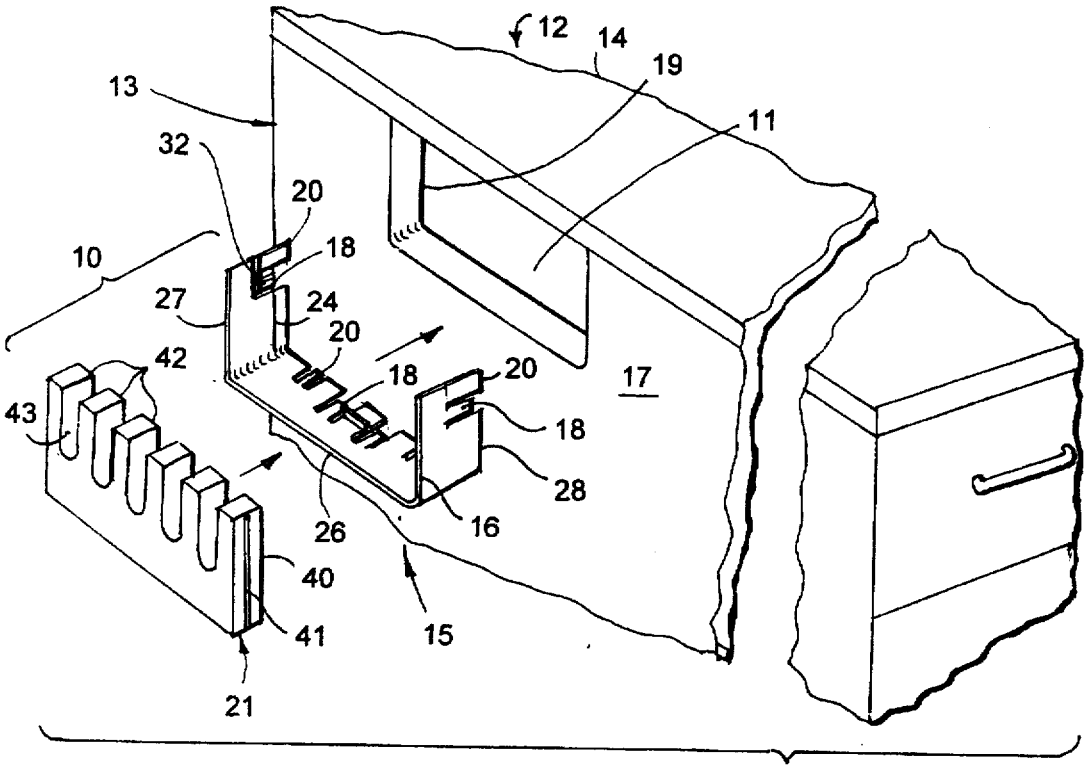
FIG. 1 is a fragmentary exploded perspective view of an insert and wood desk embodying the present invention.
Figure 3:
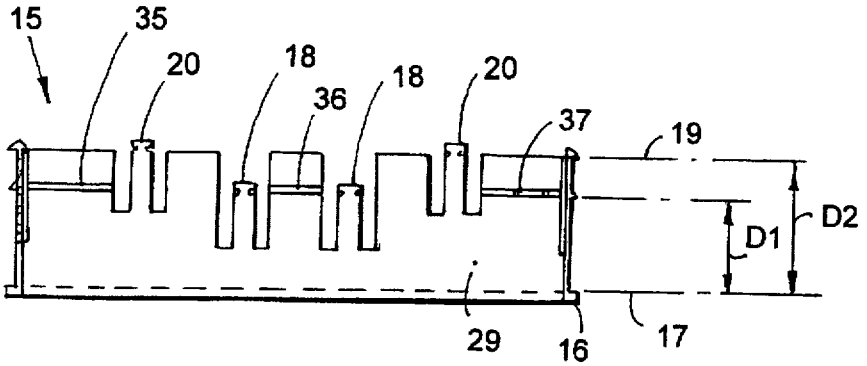
FIG. 3 is a top view of the sleeve shown in FIG. 2.
Figure 4:
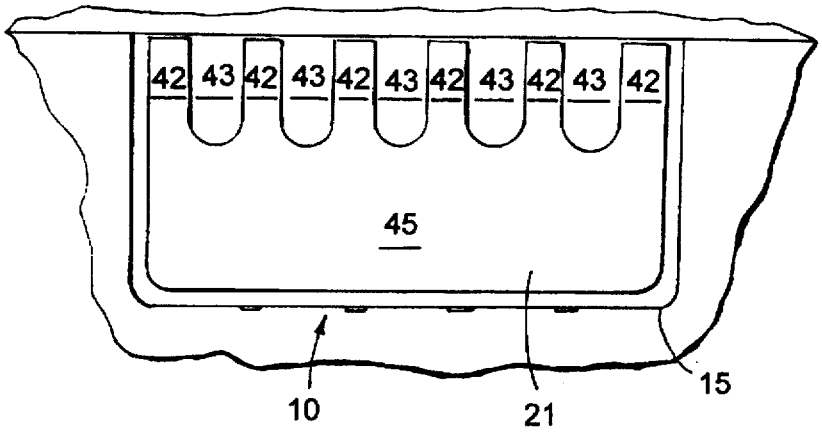
FIG. 4 is an elevational view of the desk shown in FIG. 1 including the access opening and the insert inserted therein.

The present invention includes an insert 10 (FIG. 1) for selectively filling a utility access opening or aperture 11 in furniture where the access opening 11 is formed in a panel in the furniture, such as in an end panel 13 in a desk 12 immediately below a worksurface 14. The panel 13 has a thickness that may be one of two different dimensions "D1" or "D2" (FIG. 3), depending on the structural requirements of the desk. The insert 10 includes a sleeve 15 having a lip or stop 16 for engaging an exterior surface 17 on the panel 13, short retainers 18 configured to frictionally engage an opposing inner surface 19 in opposition to the stop 16 when the panel 13 defines a first relatively thin dimension "D1", and long retainers 20 configured to frictionally engage the opposing inner surface 19 in opposition to the stop 16 when the panel 13 defines a second relatively thick dimension "D2". A port 21 mateably frictionally engages the sleeve 15 to close the access opening 11. The port 21 is frictionally held in the sleeve 15 by detents 32–33, and engages the retainers 18 and 20 to hold them securely in engagement with the panel 13. The short retainers 18 can be broken off so that they do not interfere with positioning the port 21 into the sleeve 15 when the sleeve 15 is engaged with a relatively thick panel 13.

In the illustrated desk 12, the access opening 11 is formed along a top edge of end panel 13, three sides of the access opening 11 being formed by material along the top edge of panel 13, and the top of access opening 11 being formed by the bottom of worksurface 14. The remainder of desk 12 is formed in ways generally known in the art and need not be described in detail herein for a complete understanding of the present invention. Notably, though the present invention is shown as part of desk 12, it is contemplated that the present invention can be used on a variety of different furniture arrangements, particularly those adapted for use with electrical device such as computers and the like.

Desk 12 represents a line of furniture wherein the panel 13 can be either ¾ inch thick or 1 inch thick, depending upon the functional requirements of desk 12. For example, a panel 13 having a thickness of 1 inch will be used where the desk end panel 13 will be subject to considerable stress and will require the additional strength, such as a desk without side drawers. Contrastingly, where the end panel 13 is subject to lesser stress, a panel having a thickness of ¾ inch is used.

Figure 7:
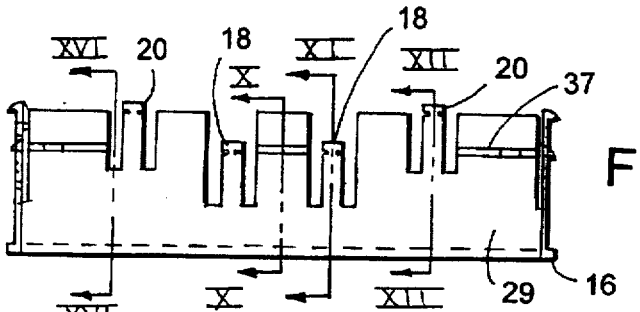
FIG. 7 is a top view of the sleeve shown in FIG. 1.
Figure 8:
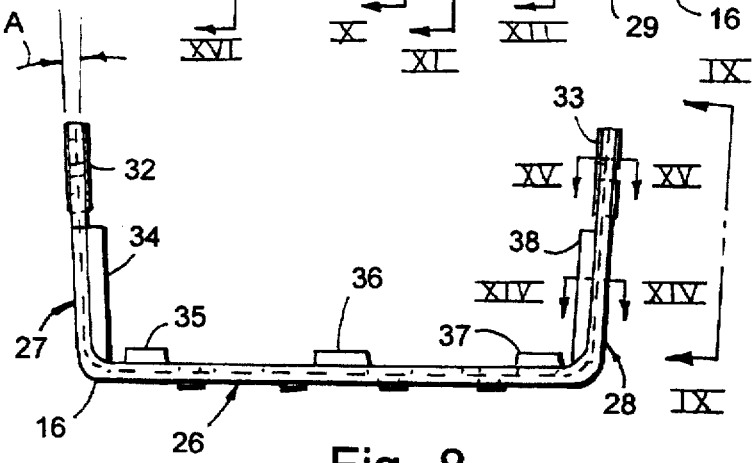
FIG. 8 is an elevational view of the insert shown in FIG. 7
Figure 9:
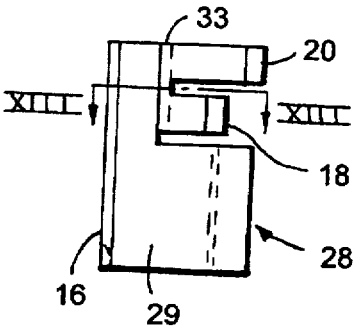
FIG. 9 is an end view of the insert shown in FIG. 7.
Figure 10:
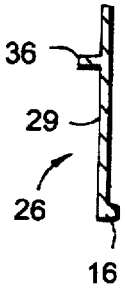
FIG. 10–16 are enlarged cross sectional views taken along the lines XX—XX, XI—XI, XII—XII, XIII—XIII, XIV—XIV, XV—XV and XVI—XVI in one of FIGS. 7–9.
Figure 11:
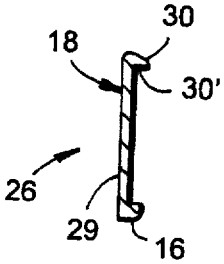
Figure 12:
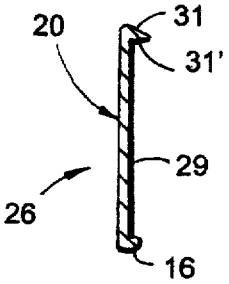

Sleeve 15 (FIGS. 7–9) comprises a U-shaped wall molded from polystyrene or other resilient but fracturable polymeric material. Sleeve 15 has a center wall section 26 and a pair of end wall sections 27 and 28 that extend from center wall section 26. A continuous band of material 29 of constant wall thickness extends around wall sections 26–28. Lip 16 extends from the exteriorly oriented edge of the band of material 29 of wall section 26–28. Lip 16 is configured to mateably engage the exterior surface 17 of panel 13 around access opening 11 to set the depth of sleeve 15 and to aesthetically cover any chips or deformations that occur along the material forming access opening 11. Sleeve 15 includes one each of retainers 18 and 20 on each end wall section 27 and 28, and includes a pair of each of retainers 18 and 20 on center wall section 26. Each short retainer 18 defines a resilient finger that extends generally parallel the wall section from which it extends, and further includes a hooked end 30 that faces outwardly. Each long retainer 20 defines a resilient finger that extends generally parallel the wall section from which it extends, and further includes a hooked end 31 that faces outwardly. The hooked ends 30 and 31 are generally similar in shape and each include a substantially perpendicular surface 30' and 31' for positively engaging the inner surface 19 of panel 13. The ends 30 and 31 are configured to frictionally interlockingly engage the end panel 13 when sleeve 15 is inserted into access opening 11, depending of course on which thickness of panel 13 they are inserted into.

Figure 13:
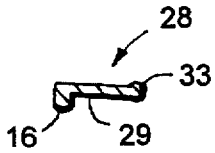
Figure 14:
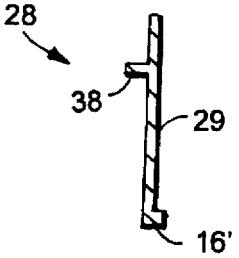
Figure 15:
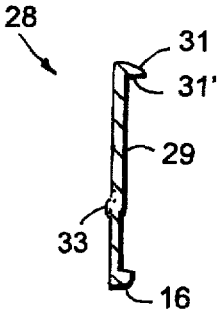
Figure 16:
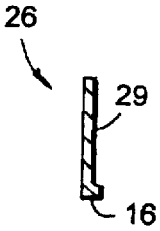

Detent forming protruding ridges 32 and 33 (FIGS. 7, 13 and 15) are defined on the inside of opposing end wall sections 27 and 28. Also, depth-setting, insertion-limiting stops or flanges 34–38 are formed around the inside of wall sections 26–28. Notably, the spacings and positions of ridges 32–33 and stops 34–38 can be placed as desired around sleeve 15 to provide the amount of stability and security of engagement required in particular applications.

Optimally, the end wall sections 27 and 28 are formed such that they are spread apart slightly when in an unstressed state. For example, where access aperture 11 is rectangularly shaped, the end wall sections 27 and 28 preferably molded such that each extends at an angle "A" (FIG. 8) that is spread a few degrees outwardly from parallel as molded (i.e. when in an unstressed state). Thus, when sleeve 15 is inserted into access opening 11, the end wall sections 27 and 28 are flexed inwardly. This causes end wall sections 27 and 28 to grippingly engage material of panel 13 forming the opposing sides of access opening 11. Thus, sleeve 15 provides an initial level of force to hold itself in the installed position.

Figure 5:
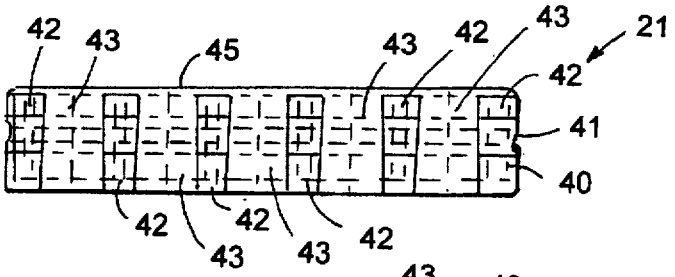
FIG. 5 is a top view of the port shown in FIG. 1.
Figure 6:
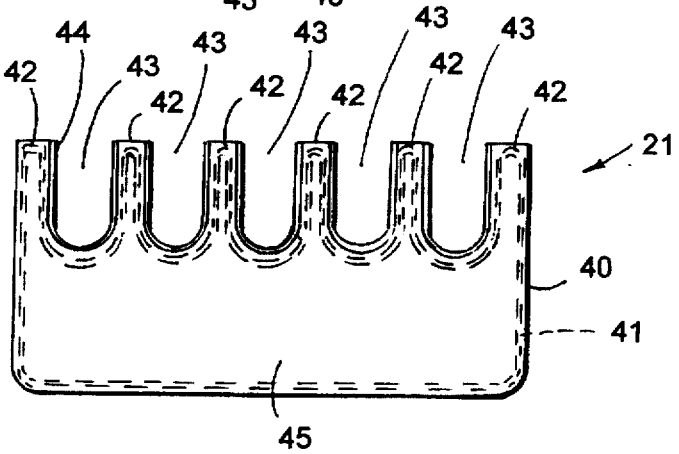
FIG. 6 is an elevational view of the port shown in FIG. 5.

Port 21 (FIGS. 5–6) is configured to generally aesthetically cover the opening defined by sleeve 15. Port 21 includes a U-shaped perimeter wall section 40 configured to mateably engage wall sections 26–28 in sleeve 15. An elongated depression 41 extends around the outside of perimeter wall section 40 for mateably engaging detent-forming ridges 32 and 33. A plurality of parallel protrusions 42 extend along one edge of port 21, and define a series of open-ended slots 43 for receiving utilities such as cables, wires, communication lines, tubes, and the like. A reinforcing web 44 extends around the edges of protrusions 42 and forms the depth of protrusions 42. The depth of perimeter wall section 40 is such that the "inner" edge of wall section 40 engages stops 34–38 as port 21 is inserted into sleeve 15 to accurately locate port 21 in sleeve 15 when port 21 is inserted into sleeve 15. A planar wall section 45 extends across half of port 21 between the lower half of the U-shaped perimeter wall section 40. As illustrated, the planar wall section 45 aesthetically covers at least about half of access opening 11, although it is noted that various shapes and sizes of wall section 45 can be used to match the decor of desk 12.

Figure 2:
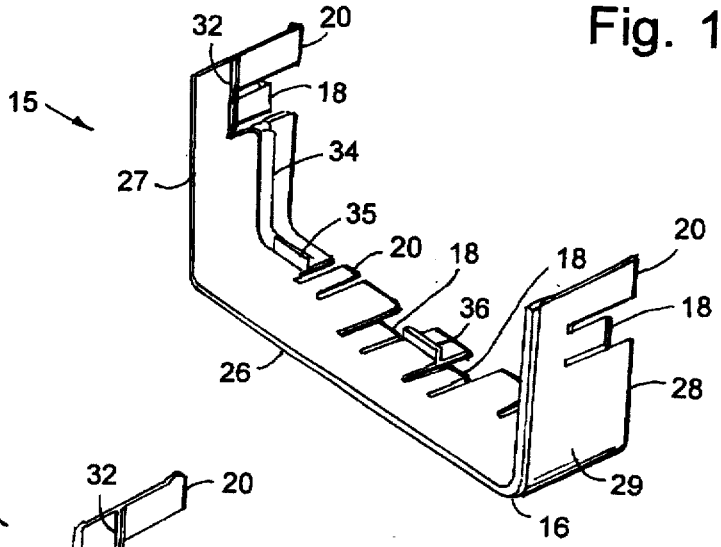
FIG. 2 is a perspective view of the sleeve shown in FIG. 1.
Figure 2A:
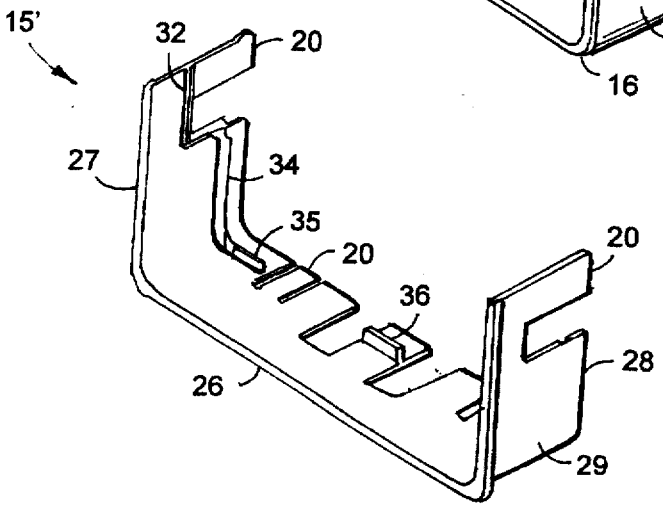
FIG. 2A is a perspective view of the sleeve shown in FIG. 2 but with the short retainers broken off.

Insert 10 is inserted into access aperture 11 by first inserting sleeve 15 and thereafter inserting port 21 into sleeve 15. Where panel 13 is ¾ inch thick, the sleeve 15 is inserted without modification, and the port 21 is thereafter pressed into position. In the installed position, the depression 41 of the perimeter wall section 40 receives and engages the detent-forming ridges 32/33 of retainers 18. The retainers 18 are held outwardly by port 21 such that the hooked ends 30 frictionally interlockingly engage the material of panel 13 defining access opening 11. Utilities are extended through access opening 11 by removing port 21, extending the utilities through the access opening 11, and thereafter re-inserting the port 21 as the utilities are arranged in the slots 43.

Where panel 13 is 1 inch thick, the sleeve 15 must be modified so that the short retainers 18 do not interferingly engage the material in the one-inch-thick panel 13 and prevent the insertion of port 21. To accomplish this, the short retainers 18 of sleeve 15 are deformed in and out until they fracture and break off thus forming a modified sleeve 15' (FIG. 2A). The material of sleeve 15 is such that the flexing is relatively easy to accomplish, and such that the retainers 18 break off after only one or two flexures. It is noted that sleeve 15 could also be manufactured from a more durable material if desired such that the material would need to be clipped off. Thereafter, the port 21 is pressed into position in the one-inch-thick panel 13. In the installed position, the depression 41 of the perimeter wall section 40 receives and engages the ridges 32/33 of retainers 18. The retainers 20 are held outwardly by port 21 such that the hooked ends 30 frictionally interlockingly engage the material of panel 13 defining access opening 11. Utilities are extended through access opening 11 by removing port 21, extending the utilities through the access opening 11, and thereafter re-inserting the port 21 with the utilities arranged in the slots 43.

A method includes providing first furniture that includes a relatively thick panel 13 having material defining a first utility access opening, and providing a sleeve 15 configured to selectively aesthetically trim the utility access openings 11 of panels 13 having different thicknesses. The sleeve 15 includes long retainers 20 configured to frictionally interlockingly engage inner and outer surfaces on the relatively thick panel 13, and further includes short retainers 18 configured to frictionally interlockingly engage inner and outer surfaces on a relatively thinner panel. The short retainers 18 are deformed back-and-forth and broken off so that the short retainers 18 do not interferingly engage material in the thick panel 13 defining the first utility access opening such that they prevent insertion of the port 21 into the sleeve 15. The sleeve 21 is then inserted into the access opening 11 where the port 21 is frictionally interlockingly engaged by the sleeve 15 and held in the access opening 11.

Thus an insert is provided for selectively filling a utility access opening in furniture where the access opening is formed in a panel in the furniture, but where the panel has a thickness that may be at least one of two different dimensions. The insert includes a sleeve having a stop for engaging a first surface on the panel, and different length retainers configured to frictionally engage an opposing surface in opposition to the stop despite the fact that the panel defines one of two different thickness dimensions. A port mateably frictionally engages the insert to close the sleeve, and is configured to frictionally engage the retainers to hold them securely in engagement with the panel. The short retainers can be broken off so that they do not interfere with positioning the port into the sleeve when the sleeve is engaged with a relatively thick panel. A related method includes breaking off the short retainers and engaging the insert with the relatively thick panel.

In the foregoing description, it will be readily appreciated by those skilled in the art that modifications may be made to the invention without departing from the concepts disclosed herein. Such modifications are to be considered as covered by the following claims, unless these claims by their language expressly state otherwise.

The embodiments of the invention in which an exclusive property or privilege is claimed are defined as follows:

What is claimed is:

1. An insert that can be used to selectively fill a utility access opening in furniture where the access opening is formed in a panel in the furniture, the panel having a first surface and an opposing surface, the surfaces defining a predetermined thickness that is one of a first thickness dimension and a second thickness dimension greater than the first thickness dimension, comprising:

a sleeve having a stop for engaging the first surface on the panel and further having first retainers configured to frictionally interlockingly engage the opposing surface in opposition to the stop when the panel defines the first thickness dimension and still further having second retainers configured to frictionally interlockingly engage the opposing surface in opposition to the stop when the panel defines the second thickness dimension, whereby the sleeve can be selectively interlockingly engaged with a panel having either the first or second thickness dimension, said sleeve being U-shaped and including end wall sections defining the U-shape that are non-parallel and slightly outwardly deformed when in an unstressed condition.

2. The insert defined in claim 1 including a port configured to mateably engage the sleeve and aesthetically cover the access opening.

3. The insert defined in claim 2 wherein the port defines open-ended slots for receiving utility cables.

4. The insert defined in claim 3 wherein the sleeve and port define mating detents for retaining the port in the sleeve.

5. The insert defined in claim 1 including a port configured to mateably engage the sleeve and aesthetically cover the access opening wherein the port defines a series of open-ended slots for receiving utility cables.

6. The insert defined in claim 5 wherein the port is configured to engage the first and second retainers to positively secure the sleeve in the access opening.

7. The insert defined in claim 5 wherein the sleeve and the port both are configured to engage the panel from an exterior side of the furniture.

8. The insert defined in claim 1 wherein the first and second retainers include short and long fingers, respectively, each including hooked ends.

9. In combination, an insert selectively filling a utility access opening in furniture where the access opening is formed in a panel in the furniture, the panel having a first surface and an opposing surface, the surfaces defining a predetermined thickness that is one of a first thickness dimension and a second thickness dimension greater than the first thickness dimension, the insert comprising:

a sleeve having a stop for engaging the first surface on the panel and further having first retainers configured to frictionally interlockingly engage the opposing surface in opposition to the stop when the panel defines the first thickness dimension and still further having second retainers configured to frictionally interlockingly engage the opposing surface in opposition to the stop when the panel defines the second thickness dimension, whereby the sleeve can be selectively interlockingly engaged with a panel having either the first or second thickness dimension, the sleeve including resilient end wall sections that extend in non-parallel directions and that are deformed outwardly relative to opposing sides of the access opening when in an unstressed condition so that the end wall sections are adapted to biasingly engage the opposing sides of the access opening when inserted into the access opening.

10. An insert for filling a utility access opening in furniture utilizing a panel having inner and outer surfaces that define a thickness dimension, comprising:

a sleeve configured to be inserted into the access opening from the outer surface toward the inner surface, the sleeve having retainers constructed to frictionally interlockingly engage the inner surface when the inner and outer surfaces define a first dimension, but which are molded from a fracturable polymer that characteristically fractures and breaks off after one to two flexures so that the retainers can be relatively easily broken away by manually bending the retainers when the inner and outer surfaces define a second dimension greater than the first dimension; and a port configured to mateably engage and aesthetically cover the sleeve, the sleeve and the port both being configured to snap in from an exterior side of the furniture.

11. The insert defined in claim 10 wherein the port engages the retainers to positively secure the sleeve in the access opening.

12. The insert defined in claim 10 wherein the port is configured to engage and hold the retainers in engagement with the furniture when installed into the sleeve.

13. The insert defined in claim 10 wherein the retainers include short and long retainers having hook-shaped ends.

14. A method comprising steps of:

providing furniture having a panel defining an access opening, the panel having a first surface and an opposing surface, the surfaces defining a predetermined thickness that is one of a first thickness dimension and a second thickness dimension greater than the first thickness dimension;

providing a sleeve having a stop for engaging the first surface on the panel and further having first retainers configured to frictionally interlockingly engage the opposing surface in opposition to the stop when the panel defines the first thickness dimension and still further having second retainers configured to frictionally interlockingly engaged the opposing surface in opposition to the stop when the panel defines the second thickness dimension;

removing the first retainers from the sleeve;

inserting the sleeve into the access opening in an installation direction and interlockingly engaging the sleeve to the panel by using the second retainers; and inserting a port into the sleeve, the port being configured to securely hold the second retainers in engagement with the panel.

15. An insert for filling a utility access opening in a furniture panel where the panel has a first surface and an opposing surface, the surfaces defining a predetermined thickness, comprising:

a sleeve having a stop adapted to engage the first surface on the panel and further having retainers configured to frictionally interlockingly engage the opposing surface in opposition to the stop, said sleeve being U-shaped and including flexible end wall sections defining the U-shape that are non-parallel and slightly outwardly deformed when in an unstressed condition.

16. A method comprising steps of:

providing a furniture panel defining an access opening;

providing a sleeve constructed to mateably engage the opening, the sleeve having retainers that are molded of a resilient but fracturable polymer that characteristically fractures after one or two flexures;

selectively removing the retainers from the sleeve by bending the retainers one to two times so that the selected retainers break away; and inserting the sleeve into the access opening.

* * * * *